United States Patent [19]

Rossmann

[11] 4,128,073

[45] Dec. 5, 1978

[54] WATER SPORTS CRAFT

[76] Inventor: George L. Rossmann, 917 Ridge Rd., Island Lake, Ill. 60042

[21] Appl. No.: 785,747

[22] Filed: Apr. 8, 1977

[51] Int. Cl.[2] ..... B63H 16/00

[52] U.S. Cl. ..... 115/22; 114/61; 115/26; 115/64; 416/7

[58] Field of Search ..... 115/21, 22, 63, 64, 115/23, 25, 26, 2, 19, 71; 114/61; 272/1 B, 69; 9/310 D; 416/7

[56] References Cited

U.S. PATENT DOCUMENTS

| | | | |
|---|---|---|---|
| 187,948 | 2/1877 | Whiting | 416/7 |
| 596,685 | 1/1898 | Ouist et al. | 115/26 |
| 3,965,843 | 6/1976 | Smith | 115/63 X |

*Primary Examiner*—Duane A. Reger
*Assistant Examiner*—Sherman D. Basinger
*Attorney, Agent, or Firm*—Beverly A. Vandenburgh

[57] ABSTRACT

A water sports craft comprises two laterally-spaced elongated pontoons with fixed, vertically inclined tread-mill propulsion apparatus mounted therebetween one end of which extends into the water the propulsion apparatus characterized by two superposed cleated, movable endless belts so mounted that linear movement of the upper belt in one direction i.e. by running on the belt causes the lower belt to move linearly in the opposite direction whereby its cleats effect propulsion of the craft through the water.

5 Claims, 3 Drawing Figures

WATER SPORTS CRAFT

BACKGROUND OF INVENTION

A survey of the prior art shows that various types of apparatus have been built for water skiing or walking on the water, these devices quite generally being in the form of a pair of floats adapted to be attached to the operator's feet and equipped with suitable means such as rubber cups, flippers, vanes and the like for effecting the desired forward movement in the water. U.S. Pat. No. 3063071 discloses traction actuated water skis, each ski comprising a panel of rigid foam plastic having depending side flanges, flexible rubber buckets on the bottom, and suitable stabilizers. As the ski is moved forwardly the rubber buckets collapse but when moved rearwardly the buckets are opened by the water thus providing traction. U.S. Pat. No. 3601828 discloses water-walking apparatus which comprises elongated shoes formed of plywood covered with fiberglass and equipped on the bottom with flippers designed to collapse when the shoe is moved forwardly and to open up and effect a scooping action when the shoe is moved rearwardly thus providing traction for walking. U.S. Pat. No. 3112504 is also directed to the construction of water shoes each shoe comprising a hollow bouyant float having a series of spring biased vanes pivotally mounted on the bottom thereof. U.S. Pat. No. 3,877,409 discloses water skis equipped with a complex arrangement of ropes and pulleys for effecting movement through the water and U.S. Pat. Nos. 3,428,015 and 2,838,022 disclose spherical water vehicles wherein propulsion is effected by an operator within the sphere.

SUMMARY OF INVENTION

The instant invention relates to water craft designed for water sports as for example running over the water; as exercise; for use in competitive games; or for just having fun in the water — one of the interesting and novel features being that it may be used effectively whether upright or upside down. In essence the water craft of this invention comprises two laterally spaced pontoons or floats between which is mounted tread-mill type propulsion means. The latter is fixedly secured between the pontoons at an acute vertical angle to the plane of the pontoons so that the lower end of the tread-mill propulsion means extends into the water irrespective of whether the craft is right side up or up side down. The tread-mill propulsion means itself comprises two endless movable belts each with transverse cleats; and supported in superposed relationship by suitable frame-members fixedly secured between the pontoons such that linear movement of one belt in one direction, as by running on the upper belt, will cause the lower belt (a portion of which will be in the water) to move linearly in the opposite direction whereby its cleats serve as vanes or paddles for propelling the craft through the water.

PREFERRED EMBOBIMENT OF THE INVENTION

Figure 1:
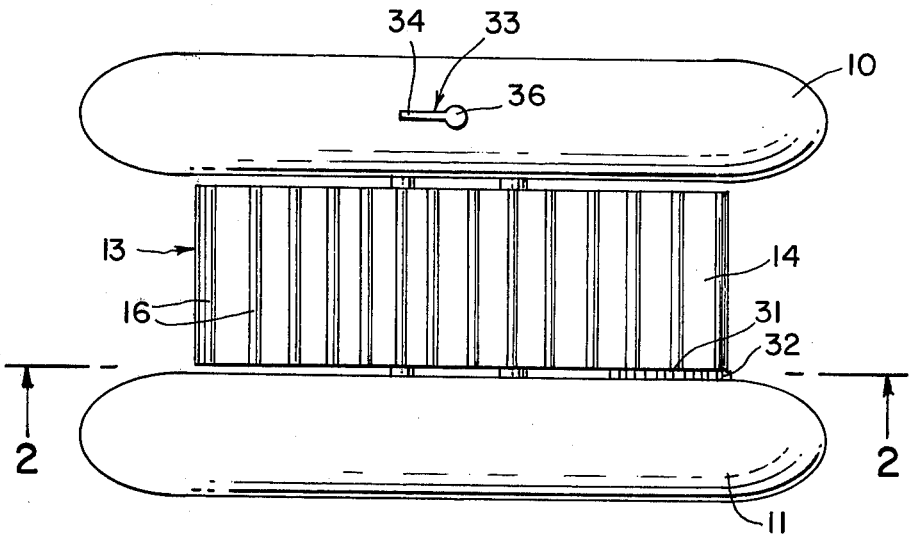
FIG. 1 is a plan view of the water sports craft of this invention.

Referring to the drawings, the water sports craft of this invention comprises two laterally spaced, parallel air tanks or pontoons 10 and 11 each constructed of plastic, fiberglass or light metal, as the case may be, with a rounded nose-portion at each end. The pontoons 10–11 are adapted to be held securely in spaced parallel relationship, as hereinafter described, by the tread-mill propulsion means of this invention, the latter indicated generally at 13.

Figure 2:
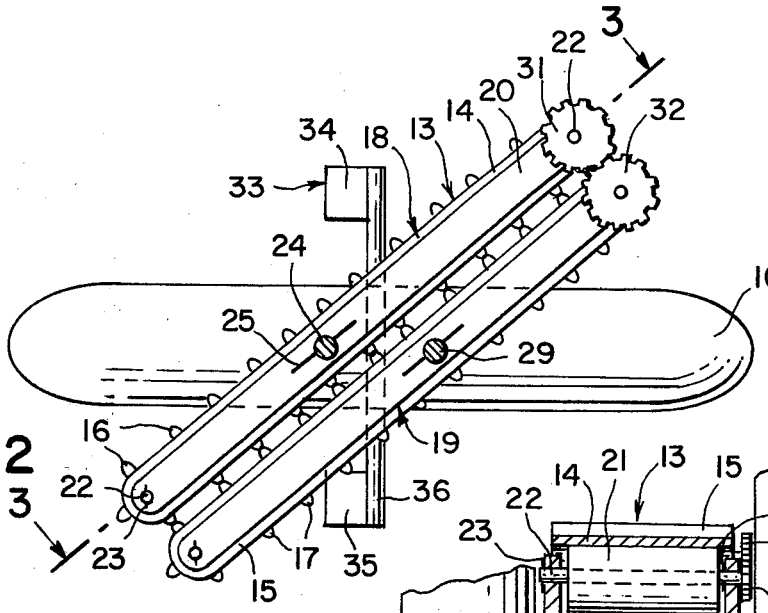
FIG. 2 is a side elevation of the craft on section line 2—2 of FIG. 1.

As shown in FIG. 2 the propulsion means 13 comprises two superposed movable endless belts 14 and 15 respectively, each formed of a suitable flexible water resistant material such as rubber or rubberized fabric, and each provided on its outer surface with a plurality of transverse cleats 16 and 17, respectively, equally spaced along the length of the belt. The cleats have two functions namely to enable an operator of the propulsion means to get a secure toe hold on the inclined belt when walking or running thereon; and to serve as vanes or paddles when immersed in the water as hereinafter described. As shown in FIG. 1 the belts are relatively wide i.e. sufficiently wide to form a stable platform on which an operator may stand or run. By way of illustration only and not limiting of the scope of the invention the endless belts may be about 18 inches wide and 54 inches long (one side) with cleats spaced every 6 inches therealong; while the pontoons may be about six feet long and from 12 to 14 inches in diameter.

Each endless belt 14 and 15, respectively, is supported for linear movement on a suitable mounting member or frame, indicated generally at 18 and 19, respectively, each of which serves both to support its respective endless belt and to fixedly secure the tread-mill propulsion means 13 to the laterally spaced pontoons 10 and 11.

Figure 3:
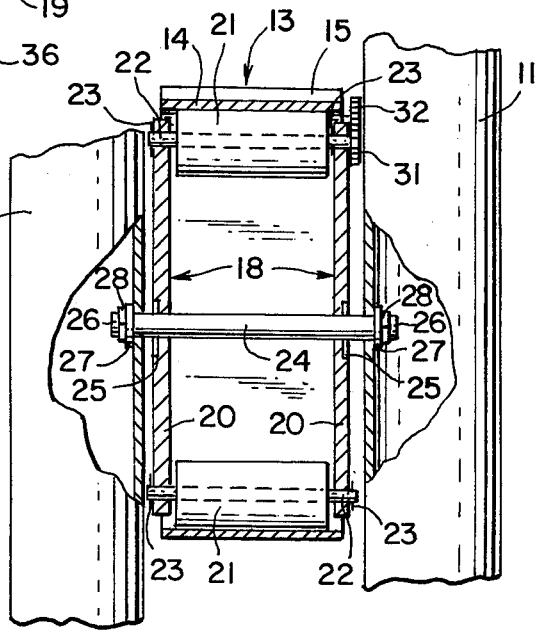
FIG. 3 is a fragmentary, longitudinal section of the craft on section line 3—3 of FIG. 2 showing details of one of the frame-members of the tread-mill propulsion means.

Details of one of these endless belt mounting members or frames are shown in FIG. 3; and since the mounting members 18 and 19 are identical the following description will, for brevity, suffice for both. As shown in FIG. 3 the mounting member 18 comprises two spaced parallel side plates 20—20 of identical construction, each an elongated rectangle, and formed of plastic, fiberglass or a suitable light metal, the length of each side plate 20 being somewhat shorter than the length of its endless belt. Rotably mounted at opposite ends, respectively, of the side plates, between the latter, are cylindrical rubber rollers 21—21 each mounted on a transverse steel shaft 22 the opposite ends of which are rotably mounted in fiber or nylon bushings in the corresponding ends of the side plates 20—20. The width of the rollers define the width of the mounting member or frame 18, which is slightly less than the width of the endless belt; while the diameter of each roller is such that its periphery extends beyond the ends, respectively, of the side plates 20—20. Further, the outer ends of each shaft project through the corresponding ends of the side plates and are locked or secured against transverse movement relative thereto by suitable lock nuts or similar fastening means indicated generally at 23—23. Thus the side plates, rollers and roller shafts combine to form a relatively rigid frame 18. The mounting member or frame 18 also includes a third steel shaft 24. The latter extends transversely through the side plates 20—20 intermediate the opposite ends thereof and is suitably keyed to the side plates, as indicated at 25, see FIG. 2, so as to preclude rotation of the frame 18 on the shaft 24; while the outer extremities 26—26 of the shaft 24 extend through suitable bushings 27—27 in the adjacent walls, respectively, of the pontoons in which bushings the shaft extremities are fixedly secured against transverse movement by lock nuts or similar fastening means indicated generally at 28—28 thus rigidly connecting the pontoons to the frame 18. In a similar manner shaft 29 of frame 19 rigidly secures the latter to the spaced pontoons by similar fastening means (not shown). Further, as stated above, the frames 18 and 19 of the endless belts 14 and 15 are adapted to be fixedly supported in an inclined position between the pontoons 10 and 11 such that the lower end of endless belt propulsion means is always in the water. Hence in addition to the shafts 24 and 29 being secured to the pontoons against transverse movement, the extremities of the shafts 24 and 29 are adapted to be keyed in their bushings in the pontoons at an angle of rotation corresponding to the desired angular inclination of the tread-mill propulsion means. While the angle is not critical nevertheless it should be selected so that the inclination of the endless, cleated belts is such that an operator may stand, walk or run thereon without loss of balance or other difficulty. By way of example the angle of inclination of the belts may be about 30°.

As stated above the endless belts are adapted to be mounted in superposed relationship and to this end the steel shaft 24 of the frame 18 of the upper endless belt, as seen in FIG. 2, is displaced rearwardly of a point intermediate the opposite ends of the pontoons while the steel shaft 29 of the frame 19 of the lower endless belt is displaced forwardly thereof. Pursuant to one form of the invention the shafts 24 and 29 are so located relative to each other that the two endless belts 14 and 15 and in particular the transverse cleats on the underside of the upper belt 14 and on the top side of the lower belt 15 are in contact. As a consequence when the upper belt is moved downwardly linearly, as by someone walking or running thereon, frictional contact between the aforesaid cleats will cause the lower belt 15 to move linearly in a direction opposite to that of the upper belt whereby its immersed cleats will act as vanes or paddles for propelling the craft forwardly in the water.

Moreover while this form of friction drive is included within the scope of the invention, the latter also comprehends means for effecting positive drive between the upper and lower belts. To this end spur gears are attached to corresponding roller shafts at the ends of the upper and lower frames 18 and 19. Thus, as shown in FIG. 3 the right hand end of the roller shaft 21 of the upper frame is extended beyond the corresponding side plate 20 and provided with spur gear 31. Similarly the corresponding roller shaft of the lower frame 19 is provided with spur gear 32 adapted to mesh with spur gear 31. Accordingly linear movement of the upper endless belt will transmit positive linear movement to the lower immersed endless belt and in the opposite direction thereby propelling the craft through the water.

When using the positive drive it is preferred that the shafts 24 and 29 of the respective frames 18 and 19 be spaced apart relative to each other such that there is substantially no frictional contact between the belts.

An added feature of the invention is the steering means by which the craft may be turned while traveling over the water. Referring to FIGS. 1 and 2 the steering means is indicated generally at 33 and comprises dual rudders in the form of a pair of rubber rudders 34—35 extending laterally from opposite ends respectively of a shaft 36 which, in turn, is mounted substantially vertically in one of the pontoons. To this end suitable axially aligned water tight bushings are provided in the top and bottom of the pontoon in which bushings the shaft 36 is rotatably mounted. In the interest of safety the shaft may be formed of a flexible plastic material. Further the length of the shaft 36 is such that when an operator is walking or running on the upper endless belt of the propulsion means he or she may manually turn the upstanding rudder 34 and hence the immersed rudder 35. The steering function of the rudders 34 and 35 is similar if the craft is turned upside down.

From the foregoing description it is apparent that the water sports craft of this invention is unique in that it is operated by a person walking or running on the inclined endless belt; that as a consequence it provides an exciting means of water transportation, invites competitive water races, or may provide a healty form of exercise. Moreover it may be used right side up or up side down. Further, it embodies relatively inexpensive materials of construction and relatively few moving parts.

The invention may be carried out in other specific ways than those herein set forth without departing from the spirit and essential characteristics of the invention and the present embodiment is therefore to be considered in all respects as illustrative and not restrictive, and all changes coming within the meaning and equivalency range of the appended claims are intended to be embraced therein.

I claim:

1. A water sports craft comprising: a pair of laterally spaced elongated pontoons, steering means mounted on one of said pontoons, and inclined tread-mill propulsion means constructed and arranged in fixed position between said laterally spaced pontoons such that one end of said propulsion means extends above said pontoons and the opposite end of said propulsion means extends below said pontoons into the water when said craft is launched, said tread-mill propulsion means comprising two endless belts, a plurality of cleats arranged transversely on the outer surface of each belt, said cleats being equally spaced longitudinally thereof, and belt mounting frame members constructed and arranged to support said belts in superposed relationship whereby linear movement of one belt in one direction effects linear movement of the other belt in the opposite direction, said belt mounting frame members comprising spaced parallel side plates, transversely arranged roller shafts at opposite ends respectively of said side plates and belt supporting rollers on said shafts, the corresponding roller shafts of each superposed frame member being provided with a spur gear, said spur gears arranged to be in contact for providing positive drive between the superposed belts.

2. A water sports craft according to claim 1 wherein said steering means comprises a shaft, means arranged to support said shaft substantially vertically in one of said pontoons for rotation therein with opposite ends of said shaft extending above and below said pontoon and rudders mounted on the upper and lower ends respectively of said shaft.

3. A water sports craft according to claim 1 wherein each belt mounting frame member has a transversely mounted shaft arranged intermediate opposite ends thereof, fastening means arranged to fixedly secure each frame member to its respective shaft and fastening means constructed and arranged to fixedly secure opposite ends, respectively, of each shaft in corresponding sides of said pontoons.

4. A water sports craft comprising: a pair of laterally spaced elongated pontoons, and an inclined tread-mill propulsion means constructed and arranged in fixed position between said laterally spaced pontoons such that one end of said propulsion means extends above said pontoons and the opposite end of said propulsion means extends below said pontoons into the water when said craft is launched, said tread-mill propulsion means comprising two endless belts, a plurality of cleats arranged transversely on the outer surface of each belt, and belt mounting frame members constructed and arranged to support said belts in superposed relationship whereby linear movement of one belt in one direction effects linear movement of the other belt in the opposite direction, said belt mounting frame members comprising spaced parallel side plates, transversely arranged roller shafts at opposite ends respectively of said side plates and belt supporting rollers on said shafts, the corresponding roller shafts of said superposed frames each being provided with a spur gear, said spur gears arranged to be in contact for providing positive drive between the said superposed belts.

5. A water sports craft according to claim 4 wherein each belt mounting frame member has a transversely mounted shaft arranged intermediate opposite ends thereof, fastening means arranged to fixedly secure each frame member to its respective shaft and fastening means constructed and arranged to fixedly secure opposite ends, respectively, of each shaft in corresponding sides of said pontoons.

* * * * *